US006065761A

United States Patent [19]

Gignoux et al.

[11] Patent Number: 6,065,761

[45] Date of Patent: May 23, 2000

[54] IN-LINE ROLLER SKATE EQUIPPED WITH A BRAKE ACTING ON THE WHEELS

[75] Inventors: Pierre Gignoux, Coublevie; Bernard Gatel, Renage, both of France

[73] Assignee: Skis Rossignol S.A., Voiron, France

[21] Appl. No.: 09/009,448

[22] Filed: Jan. 20, 1998

[30] Foreign Application Priority Data

Jan. 20, 1997 [FR] France ..... 97 00799

[51] Int. Cl.[7] ..... A63C 17/14; A63C 17/02; B60T 1/00

[52] U.S. Cl. ..... 280/11.2; 280/11.22; 188/29

[58] Field of Search ..... 280/11.2, 11.22, 280/11.19, 11.21, 87.042; 188/25, 29, 57, 4 B, 80

[56] References Cited

U.S. PATENT DOCUMENTS

| | | | |
|---|---|---|---|
| 5,308,093 | 5/1994 | Walin | 280/11.2 |
| 5,388,844 | 2/1995 | Pellegrini, Jr. et al. | 280/11.2 |
| 5,505,469 | 4/1996 | Zorzi et al. | 280/11.2 |
| 5,639,104 | 6/1997 | Haldermann | 280/11.2 |
| 5,752,707 | 5/1998 | Cottle et al. | 280/11.2 |
| 5,755,449 | 5/1998 | Pozzobon | 280/11.2 |
| 5,769,433 | 6/1998 | Zorzi et al. | 280/11.2 |
| 5,829,756 | 11/1998 | Mitchell et al. | 280/11.2 |
| 5,882,019 | 3/1999 | Pellegrini, Jr. et al. | 280/11.2 |
| 5,895,061 | 4/1999 | Gignoux | 280/11.2 |
| 5,911,423 | 6/1999 | Pellegrini, Jr. et al. | 280/11.2 |

*Primary Examiner*—Lanna Mai
*Assistant Examiner*—Jeff Restifo
*Attorney, Agent, or Firm*—Bugnion S.A.; John Moetteli

[57] ABSTRACT

The brake is constituted by a cylindrical body (18) mounted rotatably and movably radially to its axis (17) in relation to the chassis (1) of the skate so as to come into contact with the two rear wheels (4, 5) on backward flexion of the leg. The cylindrical body (18) is preferably mounted with vertical play on a lever (11) actuated by a collar (9) of the boot.

18 Claims, 11 Drawing Sheets

FIG. 1
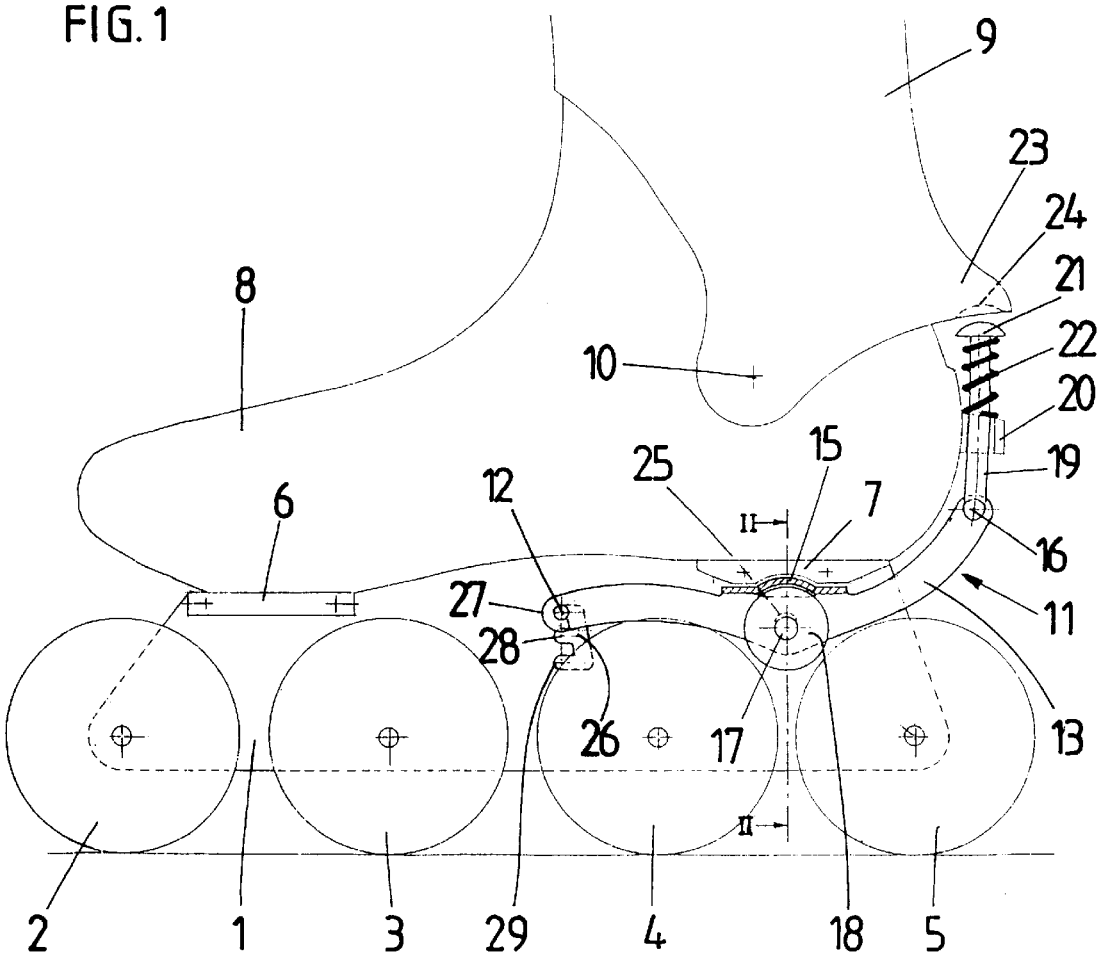
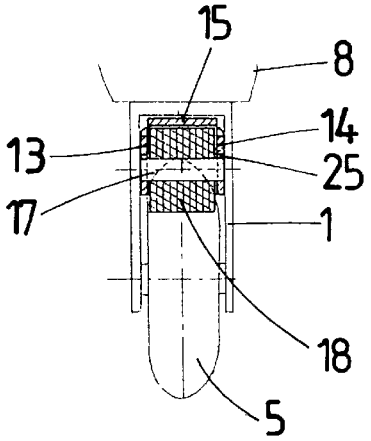
FIG. 2

FIG. 3
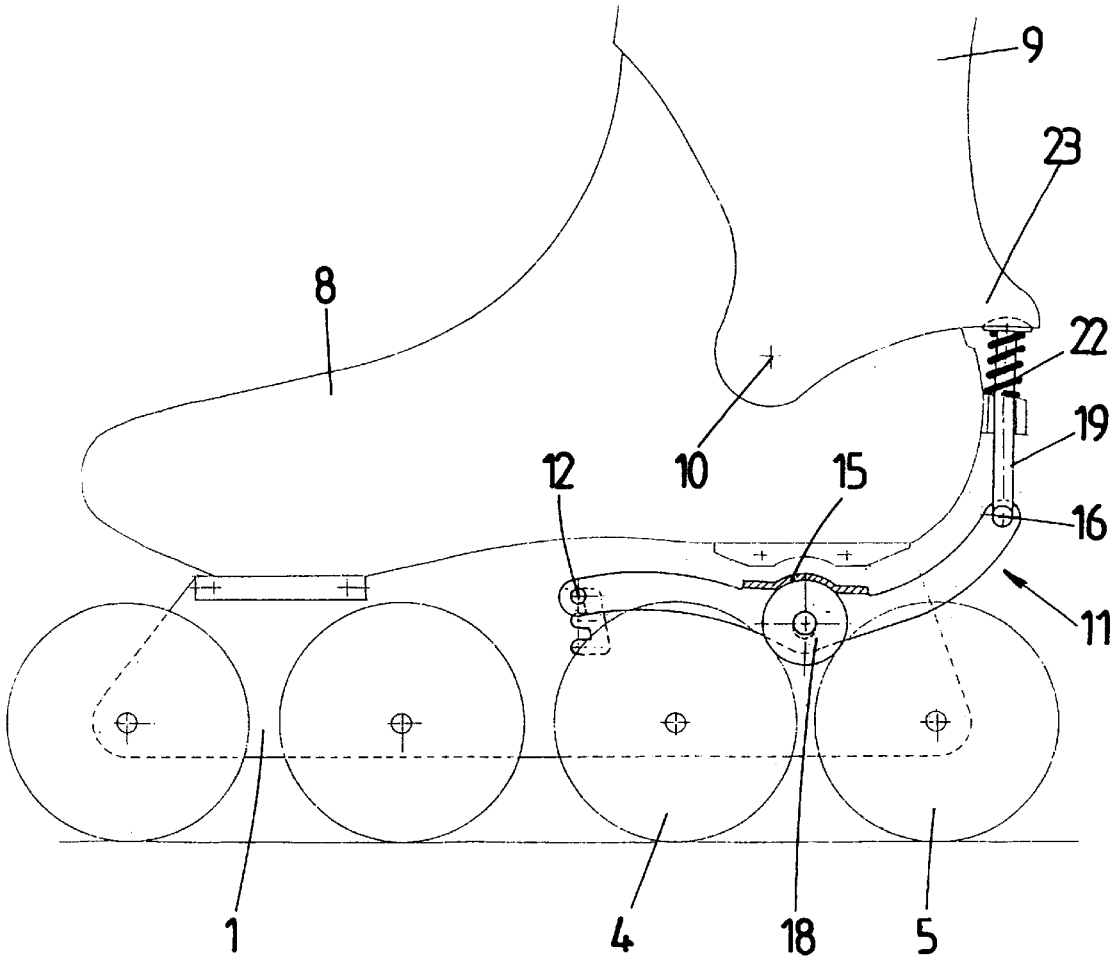
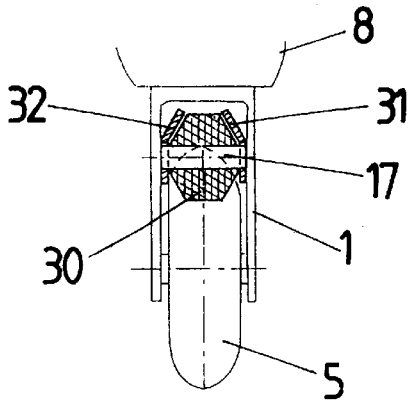
FIG. 4

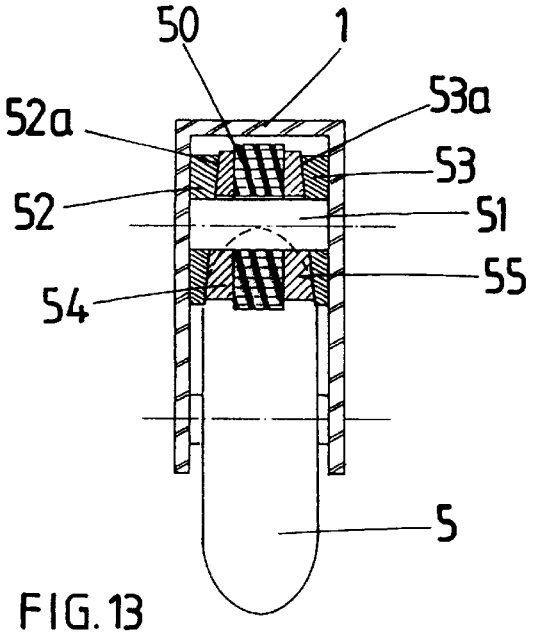
FIG. 13
FIG. 14
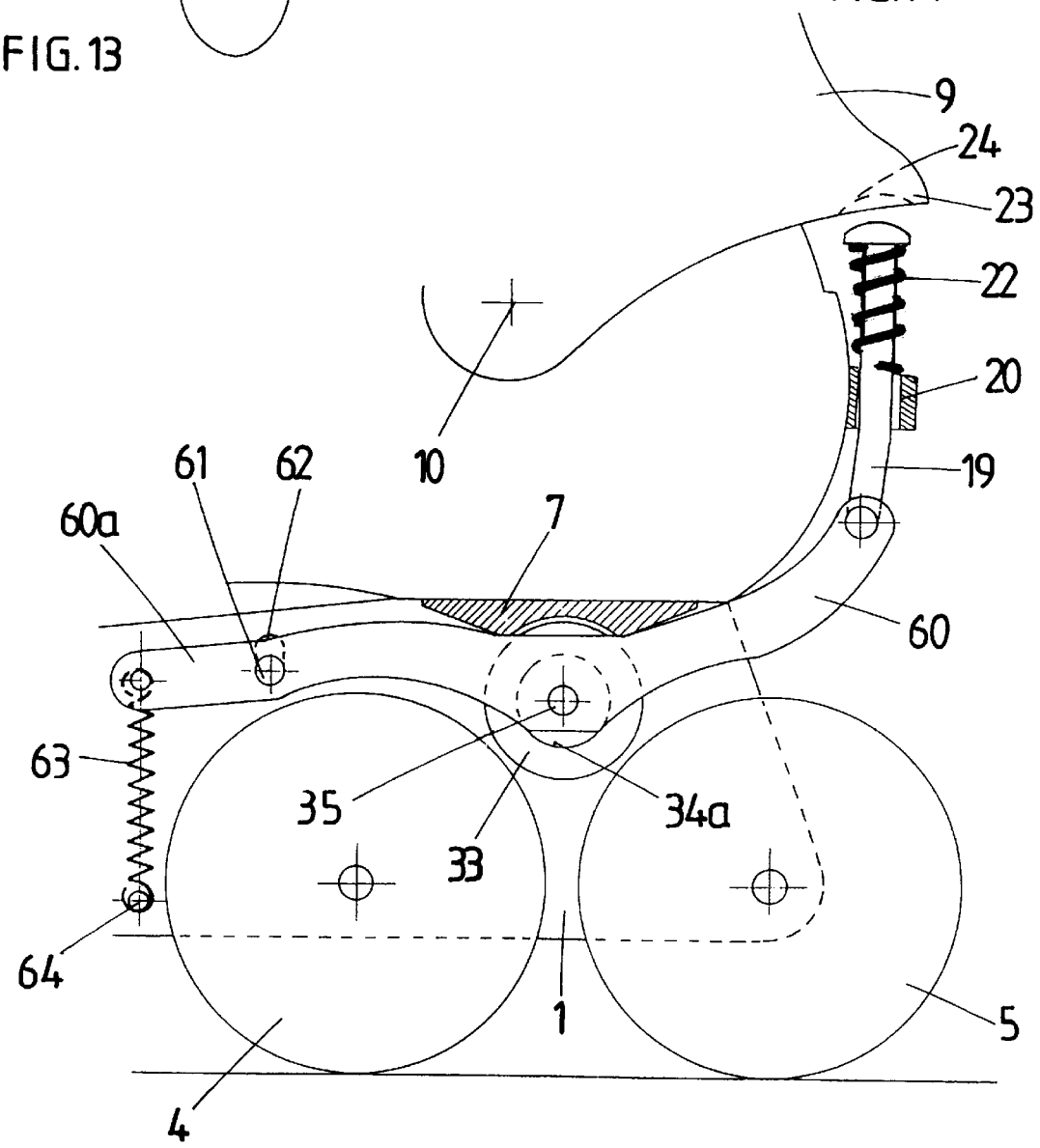

FIG. 16
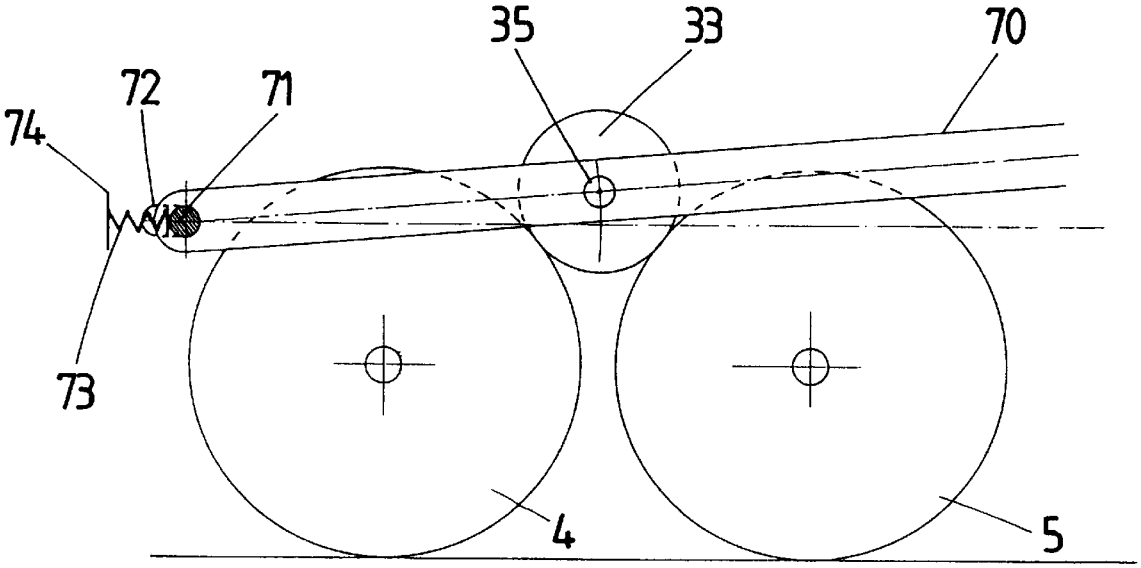
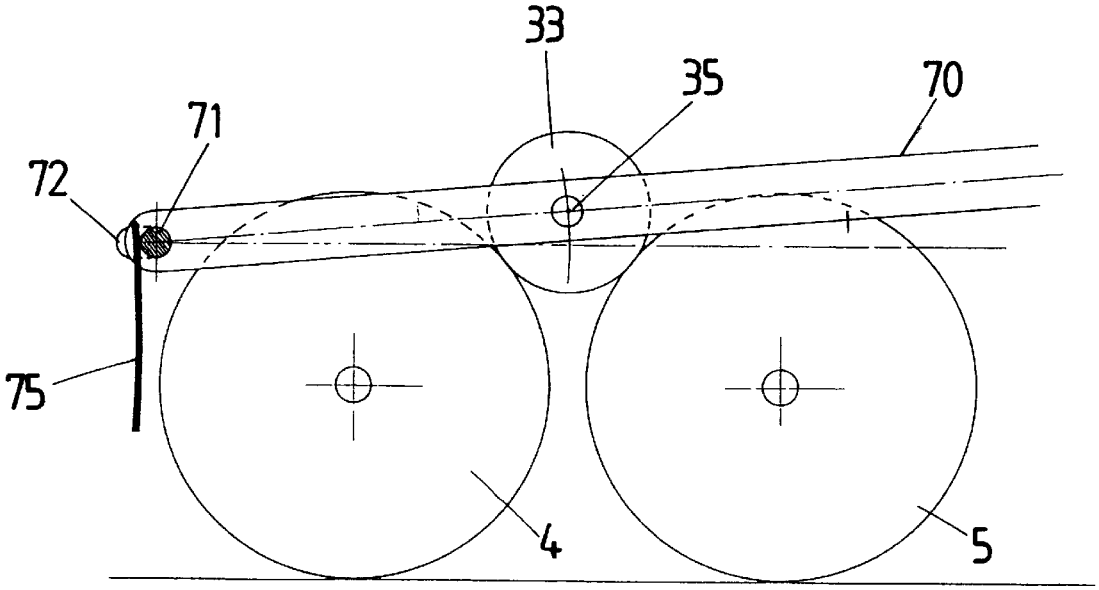
FIG. 17

IN-LINE ROLLER SKATE EQUIPPED WITH A BRAKE ACTING ON THE WHEELS

FIELD OF THE INVENTION

The invention relates to an in-line roller skate comprising a chassis bearing at least three wheels and a brake constituted by a body of revolution mounted rotatably and movably transversely to its axis in relation to the chassis so as to come into contact with at least one wheel on backward flexion of the leg.

PRIOR ART

Such a skate is known from international Patent Application WO 94/22542. In this skate, the body of revolution is in the form of a hard rotating bobbin which comes into contact with the sides of the running tread of the rear wheel. The spindle of this bobbin is integral with the support of a shoe brake which brakes in a conventional manner on the ground behind the rear wheel. The bobbin is therefore simply an auxiliary brake.

Furthermore, skates are known from U.S. Pat. Nos. 920,848 and 926,646, which comprise a lever intended to be attached to the leg via a collar and equipped with a cylindrical roller which brakes on a wheel.

Moreover, a skate is known from Patent DE 2 306 21, in which the braking is performed by a roller mounted at the end of an arm, so that when the skate tips backward on the rear wheel, the roller runs on the ground and bears against the running tread of the rear wheel.

Experience has shown, however, that braking on a single wheel leads immediately to locking of the wheel, and the sliding of the wheel on the ground, with very high friction, quickly leads to the formation of a flat area on the wheel, which necessitates the replacement of the latter, the cost of which is relatively high.

In Patent Application EP 0 763 373 of the applicant, it is proposed to produce a brake by means of two coaxial disks which are movable axially on their axis and come into contact with the two rear wheels via a frustoconical face, so that when they are applied to the two rear wheels, they are driven in rotation and pressed against friction surfaces. On braking, the weight of the skater is essentially placed on the last wheel, so that the wheel before last, retained to a lesser extent by the ground, locks more easily than the last wheel and is the first to become "squared" by friction on the ground.

It has furthermore been observed that the braking effect of the disks with the frustoconical face varied greatly with the profile of the wheels, so that the brake is difficult to adjust and braking difficult to control, which leads to additional costs.

SUMMARY OF THE INVENTION

The aim of the present invention is to avoid locking of the wheels on braking so as to avoid the formation of flat areas on the running tread.

To this end, the roller skate according to the invention is one wherein the body of revolution is cylindrical, at least in its central portion, wherein it is positioned so as to come into contact via its cylindrical portion with the two rear wheels and wherein the skate comprises at least one non-rotating braking portion against which said body of revolution is applied and rubs when it is applied against the wheels.

The body of revolution is preferably smooth and made of a material with a high coefficient of friction and low wear, such as wood, cotton fabric of varying fiber or any fibrous reinforcement impregnated with a phenolic resin of the PERMALI or Bakelite (Registered Trademarks) type, or thermosetting plastic material. However, the body of revolution could equally be made of metal, for example aluminum or steel.

The body of revolution is preferably mounted rotatably on a lever which is articulated on the chassis of the skate in front of the axis of the wheel before last and extends essentially horizontally toward the rear of the skate and is intended to be actuated by a boot mounted on the chassis.

So as to ensure gradual braking, the articulation of the lever on the chassis advantageously has vertical play and the lever is extended forward beyond its articulation, the end of this extension being stressed downward by a spring. A non-locking brake of the ABS type as is found in motor vehicles is thus obtained.

According to another embodiment, good distribution of the pressure of the body of revolution on the two rear wheels is ensured by providing the articulation of the lever on the chassis with longitudinal elastic play.

BRIEF DESCRIPTION OF THE DRAWINGS

The attached drawing shows, by way of example, a number of embodiments of the skate according to the invention.

FIG. 1 shows a first embodiment, the chassis being shown in axial section.

FIG. 2 is a view in section along II—II in FIG. 1, without the boot.

FIG. 3 shows the same skate in the braked position.

FIG. 4 shows a variant embodiment in a section similar to that in FIG. 2.

FIG. 13 is a partial view of a fourth embodiment of the brake, in a section similar to the section II—II.

FIG. 14 is a partial view of a fifth embodiment in an axial section similar to that in FIG. 1, in the unbraked position.

FIG. 16 is a diagrammatic view of a sixth embodiment.

FIG. 17 is a diagrammatic view of a variant of this sixth embodiment.

DESCRIPTION OF THE PREFERRED EMBODIMENTS

Figure 5:
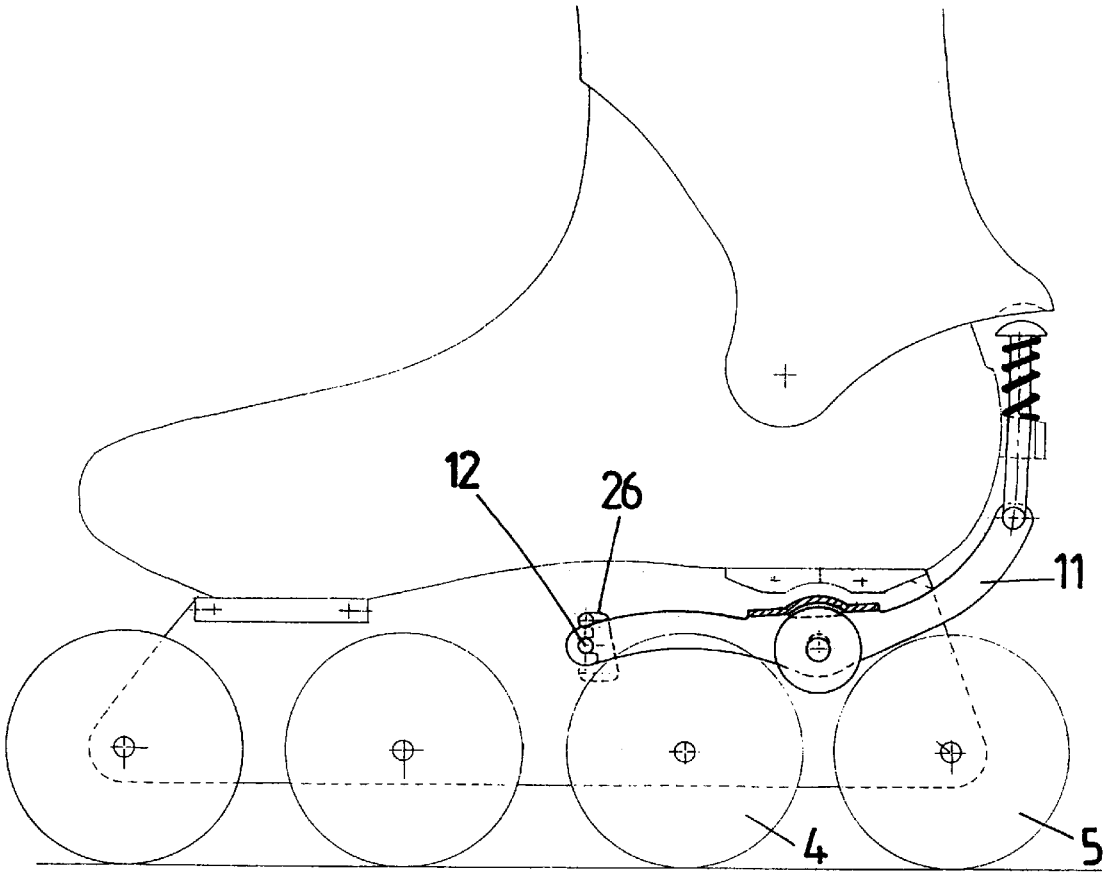
FIG. 5 shows the same skate with the brake adapted to wheels of smaller diameter.

The skate shown in FIGS. 1 and 2 comprises a chassis constituted by a U-shaped profile, made of aluminum for example, between the wings of which four wheels 2, 3, 4, 5 are mounted. The chassis 1 has two platforms 6 and 7 on which a boot 8 equipped with a collar 9 surrounding the ankle and articulated at 10 on the boot is fixed. The brake comprises a lever 11 articulated by means of a spindle 12 on the chassis 1, between the wings of the latter. This lever 11 consists of two parallel arms 13 and 14 which are interconnected by a bridge 15 as well as by the spindle 12 and, at the other end, by a spindle 16. The arms 13 and 14 and the bridge 15 are made as one single piece. Mounted rotatably about a spindle 17, between the arms 13 and 14 of the lever 11, roughly halfway between the two ends of this lever and under the bridge 15, is a smooth cylindrical body 18 made of material with a high coefficient of friction. Above this body 18, the bridge 15 has a domed portion, the concavity of which has a radius equal to that of the body 18.

The lever 11 extends essentially horizontally toward the rear and has a slight S-shaped curvature, the rear portion being directed upward. At the rear end, an essentially vertical rod 19 is articulated about the spindle 16, this rod passing through a guide eye 20 integral with the boot and being equipped with a head 21. The rod 19 is surrounded by a spring 22 working under compressive stress between the eye 20 and the head 21. The collar 9 of the boot has a portion 23 projecting toward the rear and having, on its lower face, a hollow 24 of a shape adapted to the rounding of the head 21 and located above and opposite this head.

The spindle 17 of the cylindrical body 18 is supported in the arms 13 and 14 of the lever 11 by slightly vertically oblong holes 25 which provide the spindle 17 with vertical play.

In the rest position shown in FIG. 1, the lever 11 bears via its bridge 15 against the lower face of the platform 7 under the action of the spring 22. The cylindrical body 18 is moved away from the wheels 4 and 5.

Tipping the collar 9 of the boot toward the rear has the effect of pushing the rod 19 downward, as shown in FIG. 3. The lever 11 is lowered and the cylindrical body 18 bears on the last two wheels 4 and 5 and against the bridge 15 by virtue of the oblong holes. The body 18 tends to be driven by wheels 4 and 5 but it is braked by the bridge 15. The surface area of the body 18 in contact with the wheels 4 and 5 is relatively small, so that there is no risk of the wheels locking, and braking is gradual. The bridge 15 can be coated with a friction lining.

In order that the pressure of the cylindrical body 18 on the two wheels 4 and 5 is distributed in an essentially even manner, not only must the axis of rotation of the body 18 be equidistant from the two wheels 4 and 5 but, moreover, the tangent to the circular arc described by the axis of the body 18 about the spindle 12 and passing through the axis of the body 18 must be perpendicular to the straight line connecting the axes of the wheels 4 and 5, when the body 18 comes into contact with these wheels. This is achieved by positioning the spindle 12 in an appropriate manner on the chassis. However, this positioning is valid only for a given diameter of wheel. If, then, the wheels in FIG. 1, which have a diameter of 80 mm, are replaced by wheels of a smaller diameter, for example 76 mm, the position of the spindle 12 would have to be modified in order to respect the condition specified above. So as to be able to respect this condition, the wings of the chassis 1 have cut-outs 26 defining three notches 27, 28, 29 situated one above another on a vertical line and the spindle 12 can be engaged in any one of these notches. When it is engaged in the upper notch, as shown in FIGS. 1 and 2, the conditions are met for wheels having a diameter of 80 mm. When the spindle 12 is engaged in the intermediate notch 28, as shown in FIG. 5, the conditions are met for wheels having a diameter of 76 mm. The lower notch 29 is intended for wheels of a diameter of 72 mm.

Given that the rear wheel 5 locks less easily than the wheel 4 before last, as a result of the fact that it is pressed against the ground with a considerably greater force and its adhesion to the ground is consequently greater, it is desirable that the pressure of the cylindrical body 18 of the brake is greater on the wheel 5 than on the wheel 4. This effect can be achieved simply by lowering slightly the axis of rotation 12 of the lever 11 in relation to the position defined above, so that, when the cylindrical body 18 comes into contact with the wheels 4 and 5, the circular arc described by the axis of the body 18 intersects the perpendicular passing through the axis of the body 18, as defined above. Starting from this contact position, (virtual) lowering of the axis of the body 18 results in greater pressure on the wheel 5 than on the wheel 4.

The variant embodiment shown in FIG. 4 differs from the first embodiment in that the cylindrical body 18 is replaced by a body 30 having a cylindrical central zone and two frustoconical lateral zones. The two arms of the lever 11 are no longer connected by a bridge but have, in the area of the body 30, obliquely elbowed walls 31 and 32 with the same inclination as the frustoconical faces of the body 30, so that, when the body 30 is applied to the wheels 4 and 5, these frustoconical faces rub against the walls 31 and 32. These walls 31 and 32 could also have a frustoconical concavity similar to the frustoconical faces of the body 30.

Figure 6:
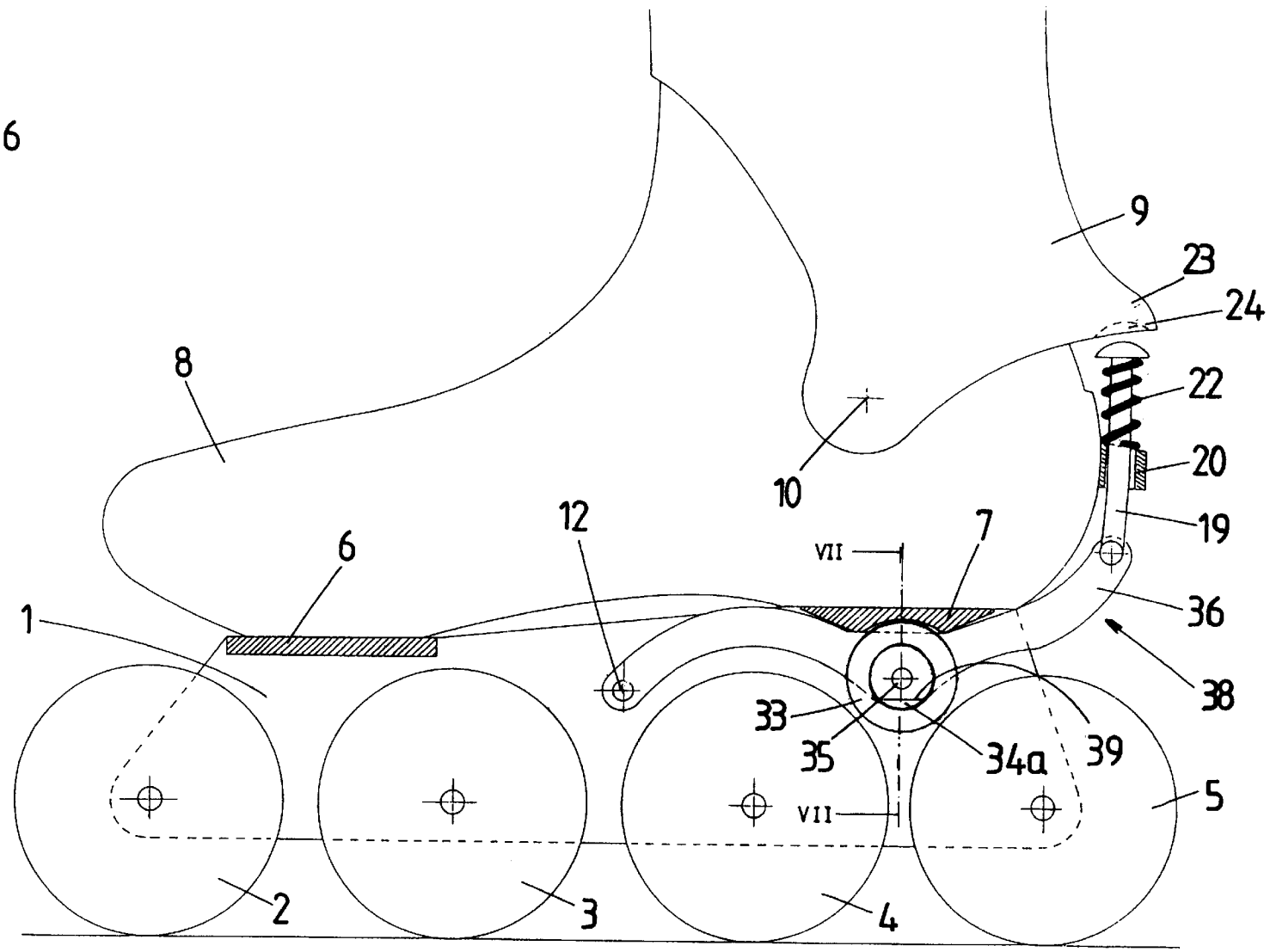
FIG. 6 shows a second embodiment in a section similar to that in FIG. 1.
Figure 7:
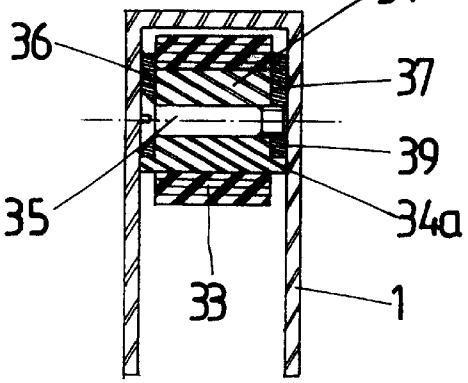
FIG. 7 is a partial view in section along VII—VII in FIG. 6.

The second embodiment, shown in FIGS. 6 and 7, differs from the preceding embodiments in that the braking does not take place directly on the lever. The cylindrical body consists in this case of a cylindrical sleeve 33 mounted rotatably about a cylindrical block 34 fixed by means of a screw 35 between the arms 36 and 37 of a lever 38 of a similar general shape to the lever 11 and articulated like it on the chassis 1 by a spindle 12 in front of the wheel 4 before last. On both sides, the body 34 overlaps, via a part 34*a*, flat areas 39 of the lever 38, so that the body is rotationally immobilized. The body 34 is shown made of metal but it could be made of synthetic material.

At the rear, the lever 38 is actuated in the same manner as the lever 11 in the preceding embodiments.

On braking, the sleeve 33 is driven in rotation by the wheels 4 and 5 and it is applied against the cylindrical block 34, against which it is braked. The friction, and consequently the heating, therefore takes place inside the sleeve 33. If this sleeve is a poor conductor of heat, as is the case in particular with PERMALI, such an embodiment therefore has the advantage of not transferring the heat to the wheels and thus of avoiding surface melting of the wheels, as can happen in certain cases.

Figure 8:
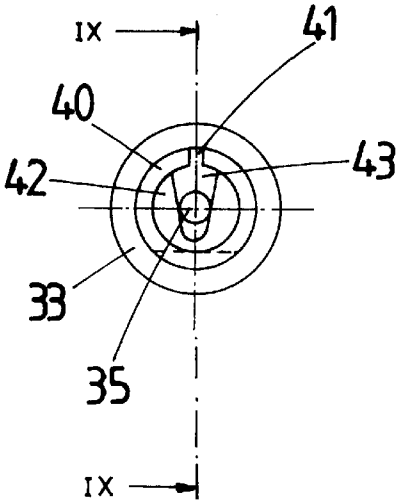
FIG. 8 shows a third embodiment of the brake.
Figure 9:
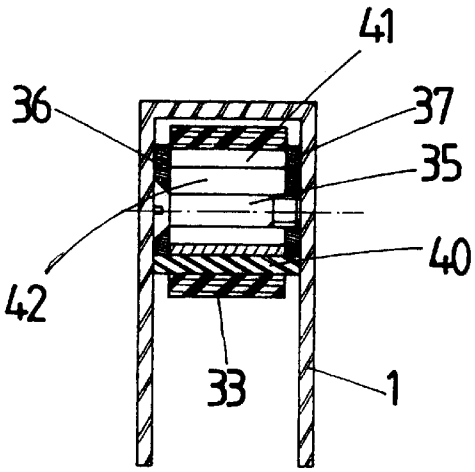
FIG. 9 is a view in section along IV—IV in FIG. 8.

The embodiment shown in FIGS. 8 and 9 is derived from the preceding embodiment. The sleeve 33 is again mounted between the arms 36 and 37 of the lever 38. The body 34 is replaced by a tubular piece 40 equipped with a longitudinal slot 41. The piece 40 is rotationally immobilized in the same manner as the piece 34. Mounted inside the tubular piece 40 is a cylindrical piece 42 having an axial V-shaped slot 43 which extends over virtually the entire diameter of the piece 42 and is passed through by the spindle constituted by the screw 35.

On braking, the spindle 35 is lowered and applies the sleeve 33 against the wheels 4 and 5, simultaneously elastically opening the slot 43, which has the effect of opening in turn the slotted tubular piece 40 and of applying the latter against the sleeve 33, which has the effect of braking the sleeve.

Figure 10:
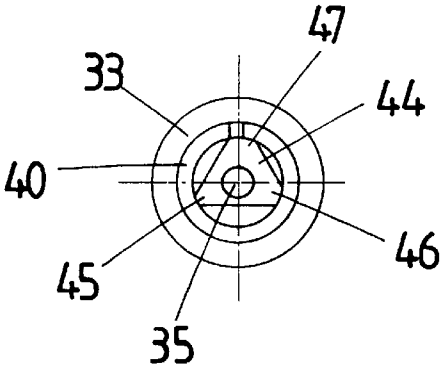
FIGS. 10, 11 and 12 show a variant of the third embodiment, in three different adjustment positions.
Figure 12:
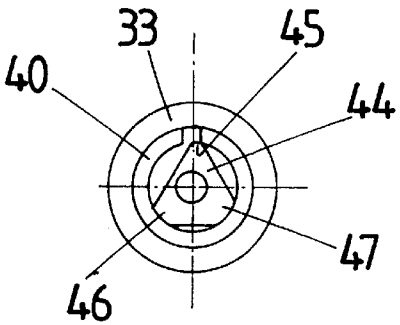
Figure 11:
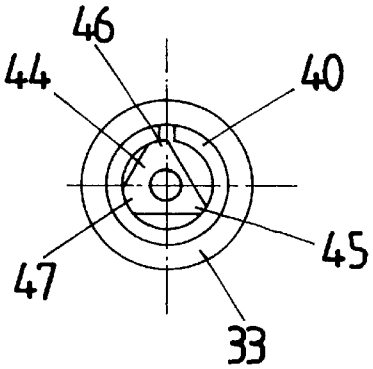

A variant of the latter embodiment is illustrated by FIGS. 10, 11 and 12. The piece 42 is replaced by a piece 44 of triangular prismatic shape with truncated corners so as to be inscribed in the slotted tubular piece 40. The prismatic piece 44 is mounted eccentrically on the spindle 35, so that its truncated edges can occupy different positions inside the tubular piece 40, according to the orientation of the piece 44.

In the position shown in FIG. 10, on the descent of the spindle 35, the prismatic piece 44 bears against the tubular piece 40 via its two truncated edges 45 and 46 which are close to the horizontal plane passing through the spindle 35, so that the pressure of the piece 44 on the tubular piece 40 exerts a relatively great opening force on the tubular piece 40 corresponding to strong braking.

In the position shown in FIG. 11, the piece 44 is orientated in such a manner that it bears on the piece 40 via its two truncated edges 45 and 47 in zones located lower than in FIG. 10, so that the opening force on the slotted tubular piece 40 is weaker. This position corresponds to a medium braking force.

In the position shown in FIG. 12, the prismatic piece 44 bears via its truncated edges 46 and 47 on the slotted tubular piece 40 in zones located lower than in FIG. 11, so that the opening force on the piece 40 is weaker again, which corresponds to a weak braking force.

Instead of braking the body of revolution of the brake by radial pressure, it is also possible to brake by axial pressure. Such an embodiment is shown in FIG. 13. The body of revolution is constituted by a relatively narrow cylindrical body 50 mounted rotatably and with vertical play about a spindle 51 supported by the two arms 52 and 53 of a lever similar to the lever 38 but having, at least in the region of the cylindrical body 50, upwardly converging oblique internal faces 52*a* and 53*a*. Also arranged between the arms 52 and 53 and the cylindrical body 50 are pieces 54 and 55 which also have vertical play in relation to the spindle 51 and oblique external faces parallel to the oblique faces 52*a* and 53*a*.

The internal space defined by the arms of the lever could be produced in a monobloc lever.

FIG. 13 shows the device in braking position. The cylindrical body 50 is pushed upward. On this movement, it draws along by friction the two pieces 54 and 55, which are applied, by wedge effect, against the flanks of the body 50, which has the effect of braking the latter. The arms 52 and 53 of the lever are retained laterally by the chassis.

Figure 15:
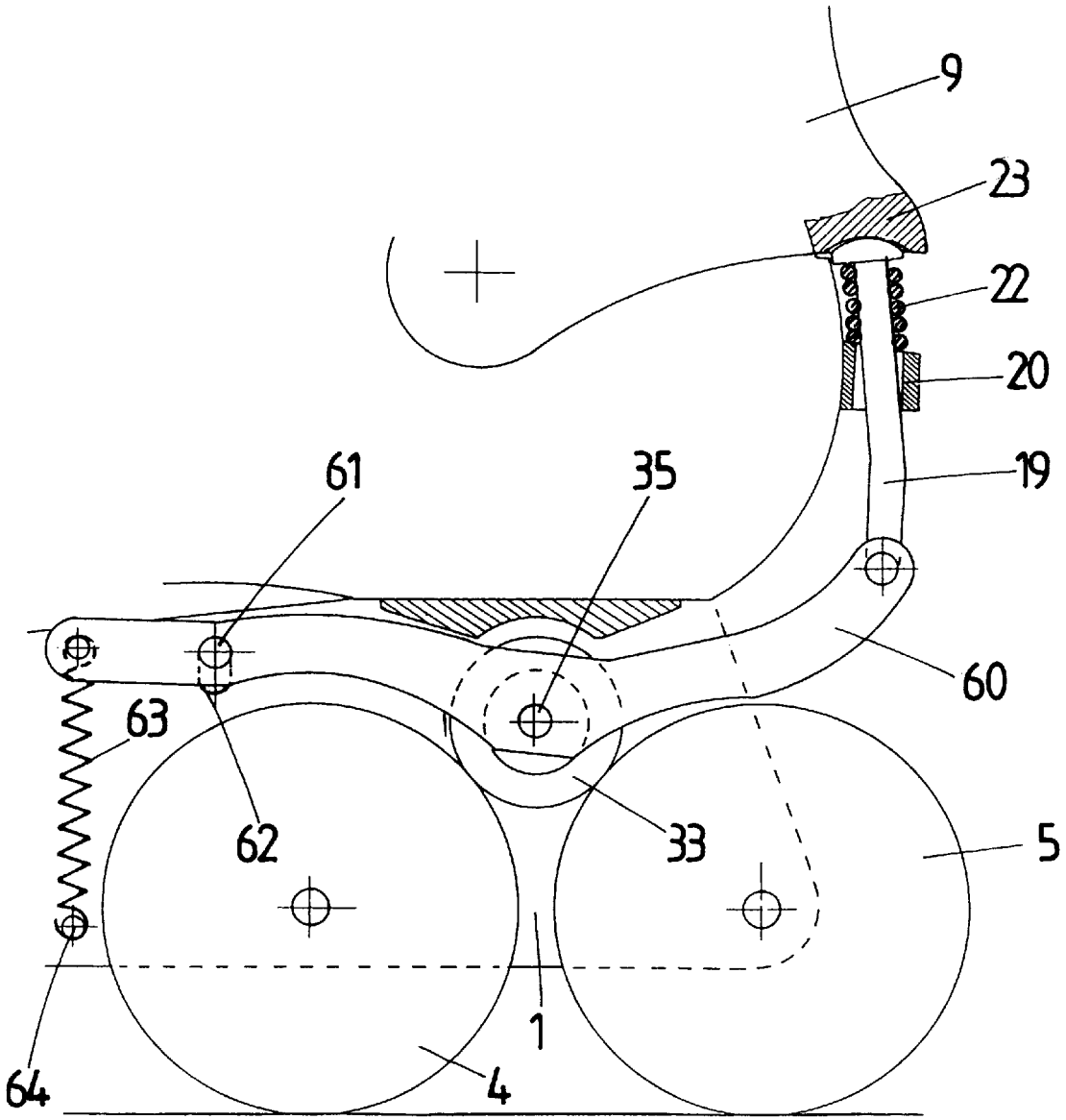
FIG. 15 shows this fifth embodiment in the braking position.

In all the embodiments described, the pressure with which the cylindrical body is applied to the wheels depends entirely on the force exerted by the skater, by means of the collar 9, on the lever. The braking force and its gradual application therefore depend entirely on the user. Consequently, in the event of very great pressure exerted on the lever by the user, and depending on the materials used, locking of the wheels, in particular of the wheel 4 before last, can occur. The embodiment shown in FIGS. 14 and 15 comprises means which make it possible to avoid such an event.

In this embodiment, a lever 60 of the same type as the lever 38 in FIG. 6 and equipped with a brake according to one of FIGS. 7 to 12 is again used. However, the lever 60 is not articulated on the chassis at a fixed point but by means of a spindle 61 which is vertically displaceable in slots 62 in the chassis. Toward the front, the lever 60 also has an extension 60*a* beyond the spindle 61, and a spring 63, working under tensile stress, connects the end of the arm 60*a* to a lower point 64 of the chassis. This spring 63 therefore has the effect of keeping the spindle 61 of the lever in the bottom part of the slots 62.

When pressure is exerted on the lever 60 by the collar 9, the lever pivots first about its spindle 61 in the position shown in FIG. 14. When the cylindrical body 33 comes into contact with the wheels 4 and 5, the lever 60 then pivots about the spindle 35. The spindle 61 is raised in the slots 62 counter to the action of the spring 63 which then determines the braking force. It is necessary for the user to increase the pressure on the rod 19 further in order for the spindle 61 to arrive in abutment in the top part of the slots 62. In this position, the spring 63 opposes the pressure on the rod 19 and tends to prevent locking of the wheels.

Gradual, non-locking braking reminiscent of ABS-type braking found in motor vehicles is thus obtained.

Moreover, if provision is made that the cylindrical body 33 first comes into contact with the wheel 4 before last, automatic distribution of the pressure of the body 33 on the wheels 4 and 5 is obtained. It is possible to avoid locking of the wheels 4 and 5 by judicious choice of the ratio of forces of the springs 22 and 63.

Another solution for ensuring distribution of the pressure of the cylindrical braking body on the wheels 4 and 5 is shown in FIGS. 16 and 17.

A lever 70 bearing a cylindrical braking body 33 and articulated on the chassis about a spindle 71 has been represented diagrammatically. This spindle 71 is not fixed but is displaceable in essentially horizontal slots 72 counter to the action of a spring 73 working under compressive stress between the spindle 71 and a stop 74 which is integral with the chassis and located in front of the slots 72. The spindle 35 of the cylindrical body 33 is positioned on the lever 70 in such a manner that the body 33 first comes into contact with the rear wheel 5 on braking. The body 33 is pushed forward against the wheel 4. This displacement is possible because the spindle 71 can be displaced forward by compressing the spring 73. An even distribution of the pressure of the body 33 on the wheels 4 and 5 is thus obtained, whatever the diameter of the wheels.

The spring 33 and the stop 74 can be replaced by a leaf spring 75 as shown in FIG. 17.

Another solution for preventing locking of the wheels consists in using a lever in the form of a flexible strip working under bending stress on braking.

The rod 19 could be made as two parts screwed one into the other so as to allow adjustment of its length and consequently adjustment of the travel of the collar 9 necessary for braking.

The body of revolution 18, and 30, 33, 50 respectively, or similar does not necessarily have to be mounted on a lever but could be applied to the wheels by other means, for example one of the constructions described and shown in Patent Application FR 96 03245.

Figure 18:
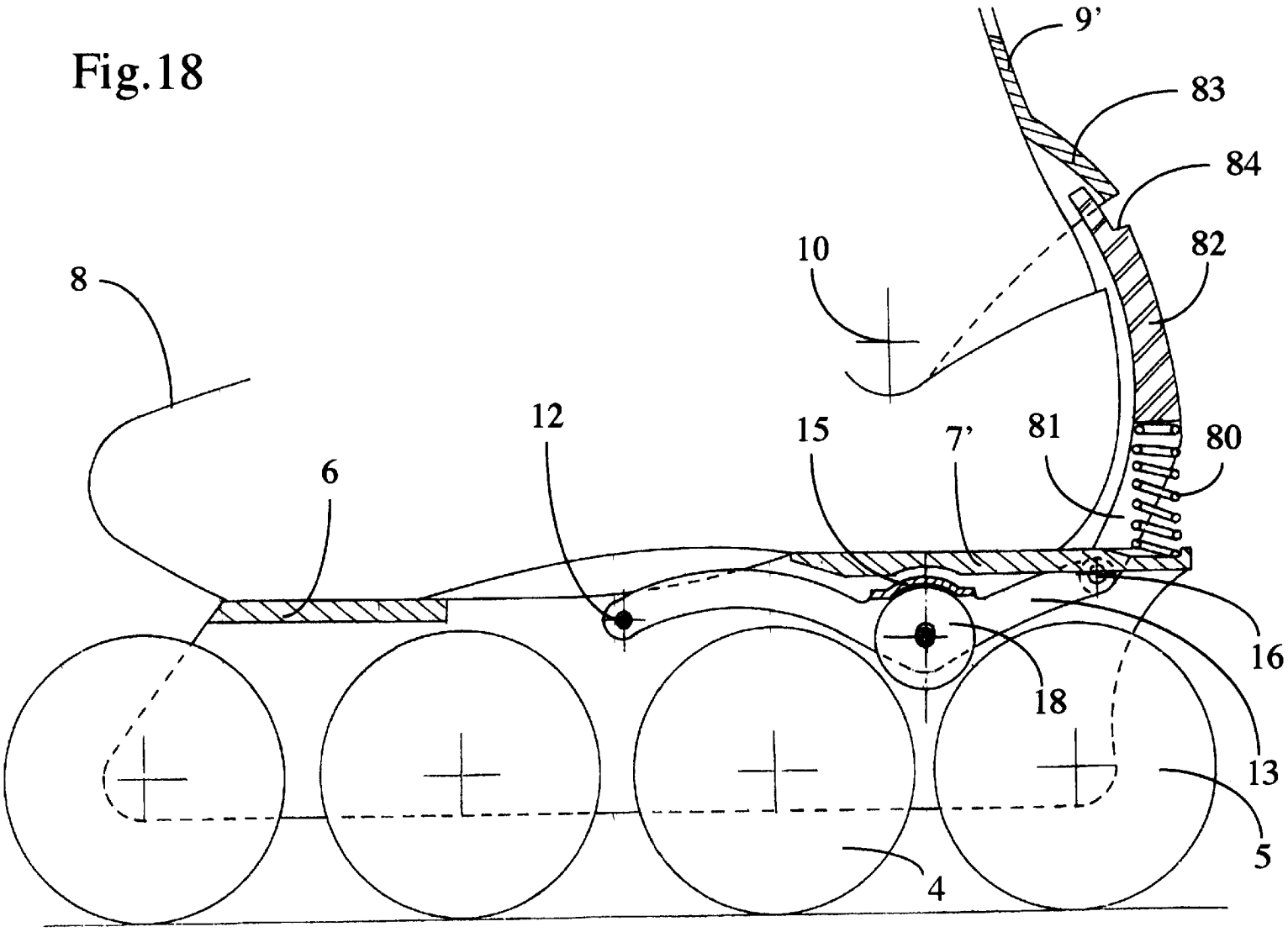
FIG. 18 shows a variant of the embodiment shown in FIGS. 1 to 5.

FIG. 18 shows a variant of the first embodiment shown in FIGS. 1 to 5. In this variant, the rod 19 is replaced by a piece 82 without a connection to the boot. This piece 82 is in the form of a domed cap which follows the rounding of the heel of the boot and has a downwardly open U-shaped cut-out 81, in which a spring 80 is arranged, which works under compressive stress between the rear platform 7' of the chassis, which is extended toward the rear for this purpose, and the bottom of the cut-out. The piece 82 engages under a skirt 83 formed by the rear lower edge of the collar 9' of the boot. On backward pivoting of the collar 9', this skirt 83 abuts against a bearing surface 84 of the piece 82 and actuates the brake by compressing the spring 80.

The intermediate piece 82 could be in any other form having a bearing point for a spring or similar working under compressive stress like the spring 80.

Figure 19:
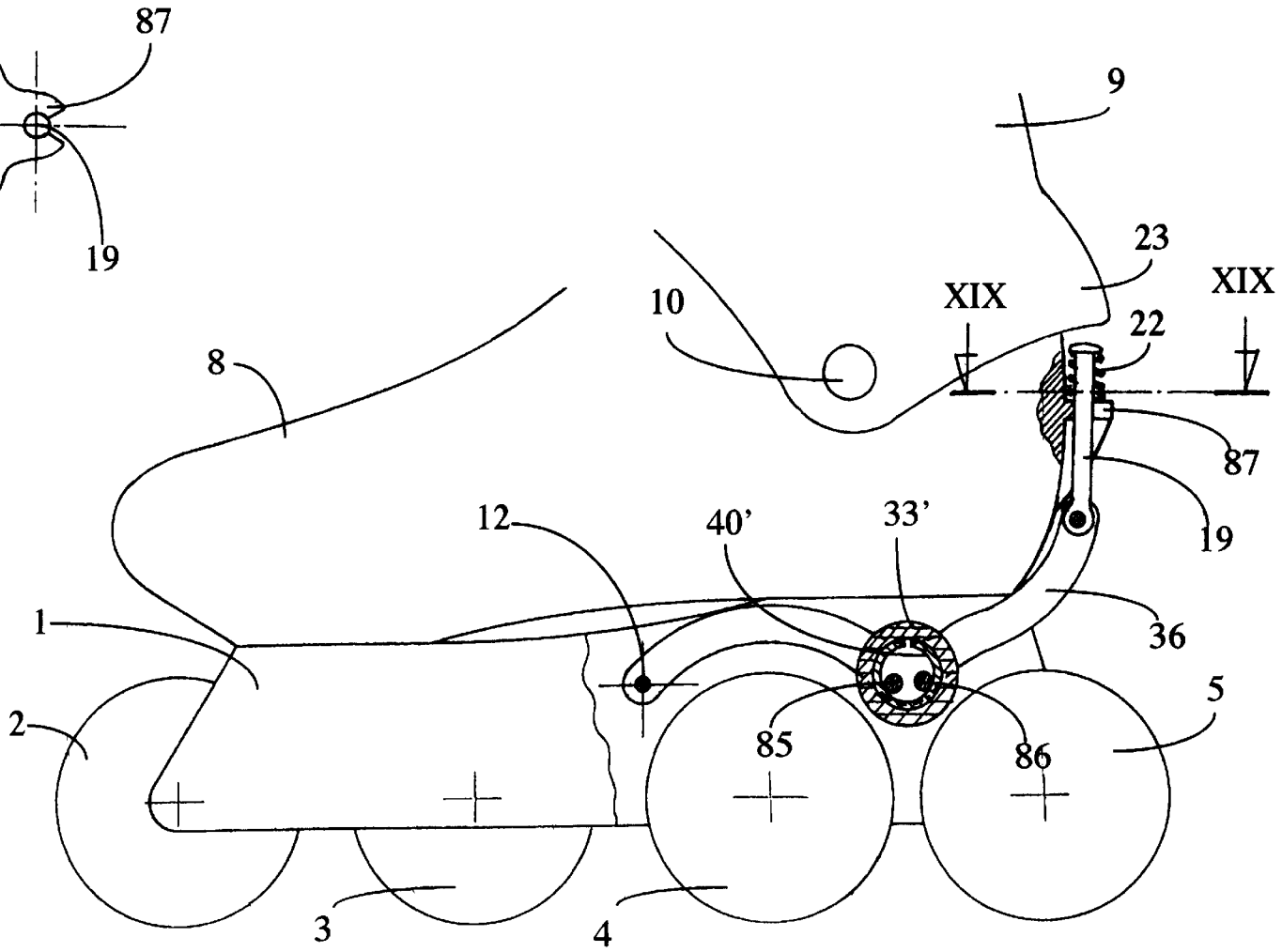
FIGS. 19 and 20 show a variant of the embodiment shown in FIGS. 6 to 11.

FIG. 19 shows a variant of the brakes shown in FIGS. 6 to 11. The cylindrical body of the brake is again constituted by a cylindrical sleeve 33' similar to the sleeve 33 and a slotted tubular piece 40' similar to the piece 40. The opening of the slotted tubular piece 40' is carried out in this case by two studs 85 and 86 fixed on the arm 36 of the brake. The rod 19 is connected in a removable manner to the boot by being force-fitted in a slotted bracket 87 of the boot, the slot of which opens elastically to allow the rod 19 to pass through.

Figure 20:
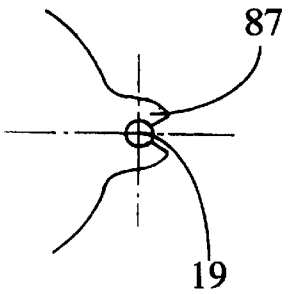

The embodiments according to FIGS. 18, 19 and 20 make it possible to equip the skate with a boot fixed removably to the chassis 1.

Figure 21:
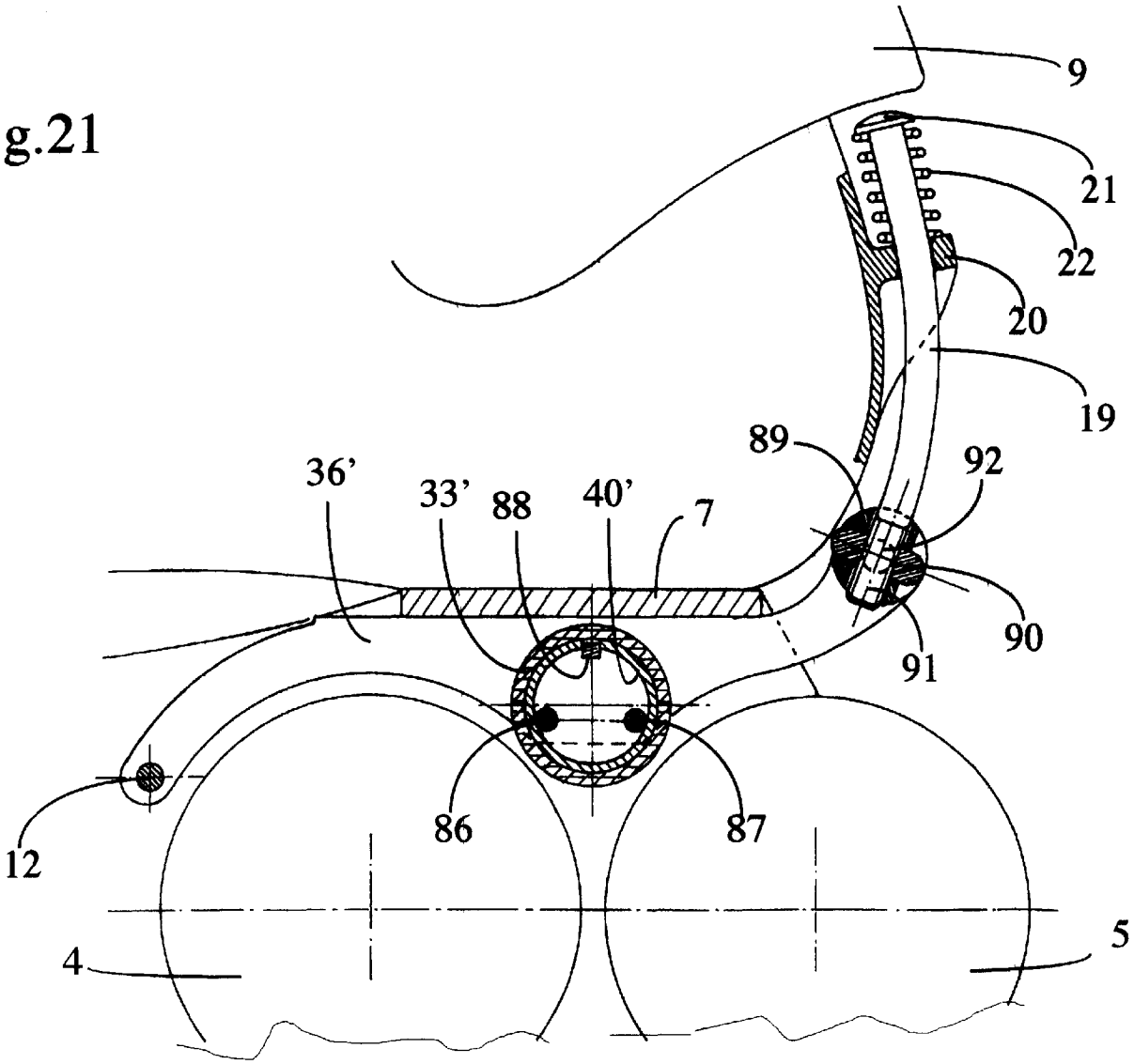
FIG. 21 shows another variant of the preceding embodiment.

FIG. 21 shows another variant of the embodiment in FIGS. 6 to 11.

The cylindrical brake is made in the same manner as in FIG. 19 with, in addition, a square stud 88 which is integral with the arm 36' bearing the brake and engages in the slot of the slotted cylindrical piece 40' so as to position this piece 40' angularly. Adjustment of the brake is also provided for at the connection of the arm 36' bearing the brake and the actuating rod 19. These adjustment means consist of a boss 89 which is mounted rotatably about a horizontal spindle 92 at the end of the arm 36' and in which a knurled nut 90 is retained, in which the threaded end 91 of the rod 19 is engaged. As the arm 36' at rest bears against the platform 7 of the chassis, rotation of the knurled nut 90 makes it possible to modify the position of the head 21 of the rod 19 in relation to the bracket 20 and to modify the precompression of the spring 22. The greater the precompression of the spring 22, the greater the travel of the collar 9 before braking and the higher the force necessary to actuate the brake.

We claim:

1. An in-line roller skate comprising a chassis (1) bearing at least three wheels (2, 3, 4, 5) and a brake constituted by a body of revolution (18; 30; 33; 50) having a central portion and an axis (17; 35; 51) to which the body of revolution is radially rotatable and movably mounted in relation to the chassis so as to come into contact with at least one wheel on backward flexion of an upper portion of the skate; wherein the body of revolution is (a) fixed against movement along the axis; (b) substantially coplanar with the wheels; and (c) cylindrical, at least in the central portion; wherein the body of revolution is positioned so as to come into contact via the cylindrical portion with the two rear wheels (4,5); and wherein the skate comprises at least one non-rotating braking portion (15; 31; 32; 34; 40; 54; 55) against which the body of revolution is applied and rubs when the body of revolution is applied against the wheels.

2. The roller skate as claimed in claim 1, wherein the body of revolution is mounted rotatably on a lever (11; 38; 60; 70) which is articulated on the chassis in front of the axis of the wheel (4) before the last wheel and extends essentially horizontally toward the rear of the skate and can be actuated by a boot (8, 9) mounted on the chassis.

3. The roller skate as claimed in claim 2, wherein said body of revolution (18; 30; 33; 50) is mounted with essentially vertical play on the lever.

4. The roller skate as claimed in claim 3, wherein the body of revolution (18) is a cylinder and wherein the non-rotating braking portion (15) is formed on the lever above the body of revolution.

5. The roller skate as claimed in claim 1, wherein the body of revolution is in the form of a cylindrical sleeve (33) mounted about a rotationally fixed cylindrical piece (34) which constitutes said non-rotating braking portion.

6. The roller skate as claimed in claim 1, wherein the body of revolution is in the form of a cylindrical sleeve (33) mounted about a longitudinally slotted and elastically deformable cylinder (40), this slotted cylinder itself being mounted in a rotationally fixed manner about a spindle (35) and tending, by means of a bearing piece (42), to open the slotted cylinder when pressure is exerted on it by said spindle (35).

7. The roller skate as claimed in claim 2, wherein said lever is flexible.

8. The roller skate as claimed in claim 2, wherein the lever (13) bearing the brake (18) is articulated on an intermediate piece (82) without a connection to the boot, which piece can be actuated by means of thrust by the boot and is pushed upward by a spring (80) working under compressive stress between the intermediate piece and the chassis.

9. The roller skate as claimed in claim 2, wherein said lever (36) is connected to an actuating rod (19) which is removably force-fitted in a slotted bracket (87) of the boot.

10. The roller skate as claimed in claim 2, wherein said lever (36') is connected to an actuating rod (19) by an articulation (92) with a boss (89), in which a knurled nut (90) is accommodated, which makes it possible to adjust the active length of the actuating rod.

11. An in-line roller skate comprising a chassis (1) bearing at least three wheels (2, 3, 4, 5) and a brake constituted by a body of revolution (18; 30; 33; 50) having a central portion and an axis (17; 35; 51) to which the body of revolution is radially rotatable and movably mounted in relation to the chassis so as to come into contact with at least one wheel on backward flexion of an upper portion of the skate; wherein the body of revolution is cylindrical, at least in the central portion, and is positioned so as to come into contact via the cylindrical portion with the two rear wheels (4,5); wherein the skate comprises at least one non-rotating braking portion (15; 31; 32; 34; 40; 54; 55) against which the body of revolution is applied and rubs when the body of revolution is applied against the wheels; wherein the body of revolution is mounted rotatably on a lever (11; 38; 60; 70) which is articulated on the chassis in front of the axis of the wheel (4) before the last wheel and extends essentially horizontally toward the rear of the skate and can be actuated by a boot (8, 9) mounted on the chassis; wherein the body of revolution (18; 30; 33; 50) is mounted with essentially vertical play on the lever; wherein the body of revolution (30) has, on both sides of a central cylindrical zone, two frustoconical portions; and wherein the non-rotating braking portion is constituted by two oblique wings (31, 32) of the lever, between which said frustoconical portions are applied.

12. An in-line roller skate comprising a chassis (1) bearing at least three wheels (2, 3, 4, 5) and a brake constituted by a body of revolution (18; 30; 33; 50) having a central portion and an axis (17; 35; 51) to which the body of revolution is radially rotatable and movably mounted in relation to the chassis so as to come into contact with at least one wheel on backward flexion of an upper portion of the skate; wherein the body of revolution is cylindrical, at least in the central portion, and is positioned so as to come into contact via the cylindrical portion with the two rear wheels (4,5); wherein the skate comprises at least one non-rotating braking portion (15; 31; 32; 34; 40; 54; 55) against which the body of revolution is applied and rubs when the body of revolution is applied against the wheels; wherein the body of revolution is in the form of a cylindrical sleeve (33) mounted about a longitudinally slotted and elastically deformable cylinder (40), this slotted cylinder itself being mounted in a rotationally fixed manner about a spindle (35) and tending, by means of a bearing piece (42), to open the slotted cylinder when pressure is exerted on it by said spindle (35); wherein said bearing piece (42) is in the form of a cylinder having a diametral V-shaped slot (43) passed through by said spindle (35) in such a manner that modification of the orientation of the bearing piece about the spindle modifies the opening forces on the slotted tubular piece.

13. An in-line roller skate comprising a chassis (1) bearing at least three wheels (2, 3, 4, 5) and a brake constituted by a body of revolution (18; 30; 33; 50) having a central portion and an axis (17; 35; 51) to which the body of revolution is radially rotatable and movably mounted in relation to the chassis so as to come into contact with at least one wheel on backward flexion of an upper portion of the skate; wherein the body of revolution is cylindrical, at least in the central portion, and is positioned so as to come into contact via the cylindrical portion with the two rear wheels (4,5); wherein the skate comprises at least one non-rotating braking portion (15; 31; 32; 34; 40; 54; 55) against which the body of revolution is applied and rubs when the body of revolution is applied against the wheels; wherein the body of revolution is in the form of a cylindrical sleeve (33) mounted about a longitudinally slotted and elastically deformable cylinder (40), this slotted cylinder itself being mounted in a rotationally fixed manner about a spindle (35) and tending, by means of a bearing piece (42), to open the slotted cylinder when pressure is exerted on it by said spindle (35); wherein said bearing piece is in the form of a triangular prism (44) which is mounted eccentrically and angularly orientable on said spindle (35) in such a manner that modification of the orientation of the bearing piece about the spindle modifies the opening forces on the slotted tubular piece.

14. An in-line roller skate comprising a chassis (1) bearing at least three wheels (2, 3, 4, 5) and a brake constituted by a body of revolution (18; 30; 33; 50) having a central portion and an axis (17; 35; 51) to which the body of revolution is radially rotatable and movably mounted in relation to the chassis so as to come into contact with at least one wheel on backward flexion of an upper portion of the skate; wherein the body of revolution is cylindrical, at least in the central portion, and is positioned so as to come into contact via the cylindrical portion with the two rear wheels (4,5); wherein the skate comprises at least one non-rotating braking portion (15; 31; 32; 34; 40; 54; 55) against which the body of revolution is applied and rubs when the body of revolution is applied against the wheels; wherein the body of revolution is mounted rotatably on a lever (11; 38; 60; 70) which is articulated on the chassis in front of the axis of the wheel (4) before the last wheel and extends essentially horizontally toward the rear of the skate and can be actuated by a boot (8, 9) mounted on the chassis; wherein the chassis (1) has two parallel wings, between which the wheels are mounted; wherein said lever (52, 53) has, at least in the region of the brake, a width essentially equal to the internal width of the chassis, and an internal space, the walls (**52*a*, 53*b*) of which are oblique and upwardly converging; wherein said body of revolution (50) is a cylinder mounted with vertical play on a spindle (51) which is integral with the lever, in said internal space, between two small plates (54, 55) likewise mounted with vertical play on said spindle and having internal faces parallel to the lateral faces of the cylinder and oblique external faces parallel to the oblique faces of said internal space, in such a manner that the application of the cylinder (50**) against the wheels has the effect of squeezing said small plates between the cylinder and the arms of the lever.

15. An in-line roller skate comprising a chassis (1) bearing at least three wheels (2, 3, 4, 5) and a brake constituted by a body of revolution (18; 30; 33; 50) having a central portion and an axis (17; 35; 51) to which the body of revolution is radially rotatable and movably mounted in relation to the chassis so as to come into contact with at least one wheel on backward flexion of an upper portion of the skate; wherein the body of revolution is cylindrical, at least in the central portion, and is positioned so as to come into contact via the cylindrical portion with the two rear wheels (4,5); wherein the skate comprises at least one non-rotating braking portion (15; 31; 32; 34; 40; 54; 55) against which the body of revolution is applied and rubs when the body of revolution is applied against the wheels; wherein the body of revolution is mounted rotatably on a lever (11; 38; 60; 70) which is articulated on the chassis in front of the axis of the wheel (4) before the last wheel and extends essentially horizontally toward the rear of the skate and can be actuated by a boot (8, 9) mounted on the chassis; wherein, at the point of articulation of the lever on the chassis, the chassis has a number of notches (27, 28, 29) situated one above the another, in one of which the lever is articulated selectively via a spindle (12).

16. An in-line roller skate comprising a chassis (1) bearing at least three wheels (2, 3, 4, 5) and a brake constituted by a body of revolution (18; 30; 33; 50) having a central portion and an axis (17; 35; 51) to which the body of revolution is radially rotatable and movably mounted in relation to the chassis so as to come into contact with at least one wheel on backward flexion of an upper portion of the skate; wherein the body of revolution is cylindrical, at least in the central portion, and is positioned so as to come into contact via the cylindrical portion with the two rear wheels (4,5); wherein the skate comprises at least one non-rotating braking portion (15; 31; 32; 40; 54; 55) against which the body of revolution is applied and rubs when the body of revolution is applied against the wheels; wherein the body of revolution is mounted rotatably on a lever (11; 38; 60; 70) which is articulated on the chassis in front of the axis of the wheel (4) before the last wheel and extends essentially horizontally toward the rear of the skate and can be actuated by a boot (8, 9) mounted on the chassis; wherein the articulation (61) of the lever on the chassis has vertical play and wherein the lever is extended (**60*a*) forward beyond its articulation, the end of this extension being stressed downward by a spring (63**).

17. An in-line roller skate comprising a chassis (1) bearing at least three wheels (2, 3, 4, 5) and a brake constituted by a body of revolution (18; 30; 33; 50) having a central portion and an axis (17; 35; 51) to which the body of revolution is radially rotatable and movably mounted in relation to the chassis so as to come into contact with at least one wheel on backward flexion of an upper portion of the skate; wherein the body of revolution is cylindrical, at least in the central portion, and is positioned so as to come into contact via the cylindrical portion with the two rear wheels (4,5); wherein the skate comprises at least one non-rotating braking portion (15; 31; 32; 34; 40; 54; 55) against which the body of revolution is applied and rubs when the body of revolution is applied against the wheels; wherein the body of revolution is mounted rotatably on a lever (11; 38; 60; 70) which is articulated on the chassis in front of the axis of the wheel (4) before the last wheel and extends essentially horizontally toward the rear of the skate and can be actuated by a boot (8,

9) mounted on the chassis; wherein the articulation (71) of the lever on the chassis has longitudinal elastic play so as to allow said body of revolution to be applied evenly to the two rear wheels.

18. An in-line roller skate comprising a chassis (1) bearing at least three wheels (2, 3, 4, 5) and a brake constituted by a body of revolution (18; 30; 33; 50) having a central portion and an axis (17; 35; 51) to which the body of revolution is radially rotatable and movably mounted in relation to the chassis so as to come into contact with at least one wheel on backward flexion of an upper portion of the skate; wherein the body of revolution is cylindrical, at least in the central portion, and is positioned so as to come into contact via the cylindrical portion with the two rear wheels (4,5); wherein the skate comprises at least one non-rotating braking portion (15; 31; 32; 34; 40; 54; 55) against which the body of revolution is applied and rubs when the body of revolution is applied against the wheels; wherein the body of revolution is in the form of a cylindrical sleeve (33') mounted about a longitudinally slotted and elastically deformable cylinder (40'), this slotted cylinder being supported by two studs (85, 86) which tend to open the slotted cylinder when said cylindrical sleeve is applied against the wheels.

* * * * *